US012234834B1

(12) United States Patent
Chen

(10) Patent No.: US 12,234,834 B1
(45) Date of Patent: Feb. 25, 2025

(54) ERGONOMIC NECK FAN

(71) Applicant: Chunzhixiao (Shenzhen) Technology Co., Ltd., Guangdong (CN)

(72) Inventor: Yu Chen, Guangdong (CN)

( * ) Notice: Subject to any disclaimer, the term of this patent is extended or adjusted under 35 U.S.C. 154(b) by 0 days.

(21) Appl. No.: 18/451,439

(22) Filed: Aug. 17, 2023

(51) Int. Cl.
*F04D 29/42* (2006.01)
*F04D 17/08* (2006.01)
*F04D 29/44* (2006.01)

(52) U.S. Cl.
CPC ..... *F04D 29/4226* (2013.01); *F04D 17/08* (2013.01); *F04D 29/441* (2013.01)

(58) Field of Classification Search
CPC ..... F04D 29/40; F04D 29/42; F04D 29/4206; F04D 29/4226; F04D 29/44; F04D 29/441; F04D 17/08
See application file for complete search history.

(56) References Cited

U.S. PATENT DOCUMENTS

2018/0209432 A1* 7/2018 Lee ..... F04D 25/08
2020/0187574 A1* 6/2020 Te Hsiang ..... A41D 13/0053
2021/0355959 A1* 11/2021 Liu ..... F04D 25/084
2022/0235786 A1* 7/2022 Liu ..... F04D 29/624

* cited by examiner

*Primary Examiner* — Elton K Wong

(57) ABSTRACT

An ergonomic neck fan comprises two fan shells for wearing around the neck of the user, and a silicone assembly. The interior of each shell is provided with a fan and cavity wall, and each shell comprises a shell body and a shell rear cover. Air guide components are provided inside the shells, and the air guide components cooperate with the cavity walls to divide the interior space of the shell body into an air outlet assembly and a storage cavity. The air outlet assembly comprises a fan cavity for placing the fan, and a horn-shaped air duct. The invention achieves high-speed airflow and efficient transfer, enabling the wind pressure towards the user's face and neck to be stronger and adaptable to different body shapes in outdoor and sports scenarios, allowing the user to be cooled by the wind and providing a better cooling effect and lower noise.

6 Claims, 6 Drawing Sheets

ERGONOMIC NECK FAN

1. TECHNICAL FIELD

The invention relates to the technical field of neck fans, in particular to an ergonomic neck fan.

2. BACKGROUND ART

At present, various portable fans have appeared on the market, such as handheld fans, neck fans, head-clipping fans, desktop fans and others, which provide cool air for users. Compared with handheld fans that need to aim at body parts with one hand to blow air, head-clipping fans and desktop fans require to be fixed on specific objects to blow air. Neck fans free both hands and are especially suitable for outdoor, sports, work and other environment.

Most existing neck fans adopt a U-shaped, semi-circular or arc-shaped shell design with a fan installed inside the fan shell. The airflow generated by the rotating fan blows from the air outlet to the human neck along the air duct. Due to the uneven shoulder and neck part of the human body and differences in body shape, most fans have deficiencies such as being unable to blow towards the human face and unstable wearing that chokes the neck. In addition, since the air duct is not professionally designed to meet aerodynamic requirements, it results in low airflow transmission efficiency, a short effective airflow path, and very weak airflow from the rear air outlet. The fans also have high operating noise and other deficiencies.

3. SUMMARY OF THE INVENTION

The invention aims to provide an ergonomic neck fan to solve the problems of low airflow transmission efficiency, short effective airflow path, very weak airflow from the rear air outlet, and high fan operating noise existing in current neck fans proposed in the background art.

To realize the above purposes, the invention provides the following technical solutions: An ergonomic neck fan, comprising two fan shells provided in mirror image for wearing around the neck of the user, and a silicone assembly provided between the two fan shells for connecting the two fan shells, wherein the interior of each shell is provided with a fan and cavity wall; wherein an air window is provided inside the a-segment end of each fan shell and provided opposite to the fan, and each fan shell comprises a hollow shell body and a shell rear cover clamped to the shell body; each fan shell is provides with an air guide component inside, to cooperate with the cavity wall to divide an interior space of the shell body into an air outlet assembly and a storage cavity, and an outer wall of the shell body is formed with air outlet holes thereon;

the air outlet assembly comprises a fan cavity for accommodating the fan and a horn-shaped air duct connected to the fan cavity; the air duct communicates with hole passages of the air outlet holes and is formed by the air guide component cooperating with the shell body; the air guide component consists of a front segment, a middle segment and a rear segment, and is provided in an irregular Z-shaped three-segment structure; the front segment of the air guide component intersects the cavity wall, and an intersection point forms a windward angle of 50 to 80 degrees.

Preferably, the front segment of the air guide component is provided perpendicular to the air duct to form a second segment of the air duct, and the front segment of the air guide component is connected to the cavity wall; the middle segment of the air guide component forms the air duct which has a cross-sectional area gradually decreasing with the fan shell, and the rear segment of the air guide component forms a 100 to 150 degree angle with the middle segment; the air outlet holes are continuously provided from the top surface of the air duct's second segment towards the tail of the air duct, each air outlet hole is provided in a rounded rectangular structure, and the outline dividing lines between the air outlet hole and a fan shell body are equally distributed on the side of the air duct shell body top surface at angles of 65 to 85 degrees.

Preferably, an angle between the rear segment and the middle segment of the air guide component is 125 to 140 degrees, and the angle vertex is provided with a rounded-angle structure.

Preferably, a positioning pin is provided on a downward extended line of the air guide component middle segment, and the positioning pin is provided on the storage cavity; a fan is provided on the downward extended line of the middle segment and proximate to the windward angle side, and the fan is fixed to the positioning pin to form a spiral cavity.

Preferably, the windward angle is provided for reducing noise generated by the high-speed airflow in the air duct; an included angle of the windward angle is 60 to 70 degrees, and a vertex of the windward angle is provided in an inverted rounded-angle structure.

Preferably, the fan adopts a centrifugal fan, the air window is an air window with a segmented pie profile, and the diameter of the air window is equal to the blade dimensions of the fan.

Preferably, the silicone assembly is provided in an arc-shaped structure, a b-segment of the fan shell together with the silicone assembly surrounds a rear portion of a human neck; the silicone assembly is fixed to the fan shell body by a fixing component, and the silicone assembly comprises a silicone sleeve and a metal spring hose; the metal spring hose penetrates through the silicone sleeve, and the silicone sleeve has a hollow structure.

Preferably, the neck fan further comprising an energy storage battery and a control unit provided inside the fan shell body, wherein an a-segment of the fan shell body starts from a human clavicle and hangs down along a shoulder, two a-segments of the fan shell bodies converge towards the center of a human chest; and a cavity of the a-segment gradually enlarges to accommodate the fan, the energy storage battery and the control unit; both the energy storage battery and the control unit are provided in the storage cavity.

Preferably, the control unit comprises a control mainboard and a switch function board; the control mainboard is provided on a positioning pin in the storage cavity, control wires of the energy storage battery and the fan penetrate through the metal spring hose, and the control mainboard adopts Type-C charging.

Compared to the prior arts, the invention has the following beneficial effects:

The invention has an adjustable, arc-shaped neck-wrapping, and downward hanging shoulder-clinging structure, which makes the human body wear it stably and comfortably. The control buttons provided on the side make it more convenient to operate the fan. The coordination between the air guide component, the horn-shaped air duct, and the air outlet achieves high-speed airflow and efficient transfer, so that the wind pressure blown towards the human face and neck is stronger, adapts to different body shapes for outdoor and sports scenarios, and enables the user's neck and face to be cooled by the wind with a better cooling effect and lower noise.

4. BRIEF DESCRIPTION OF ACCOMPANY DRAWINGS

Figure 1:
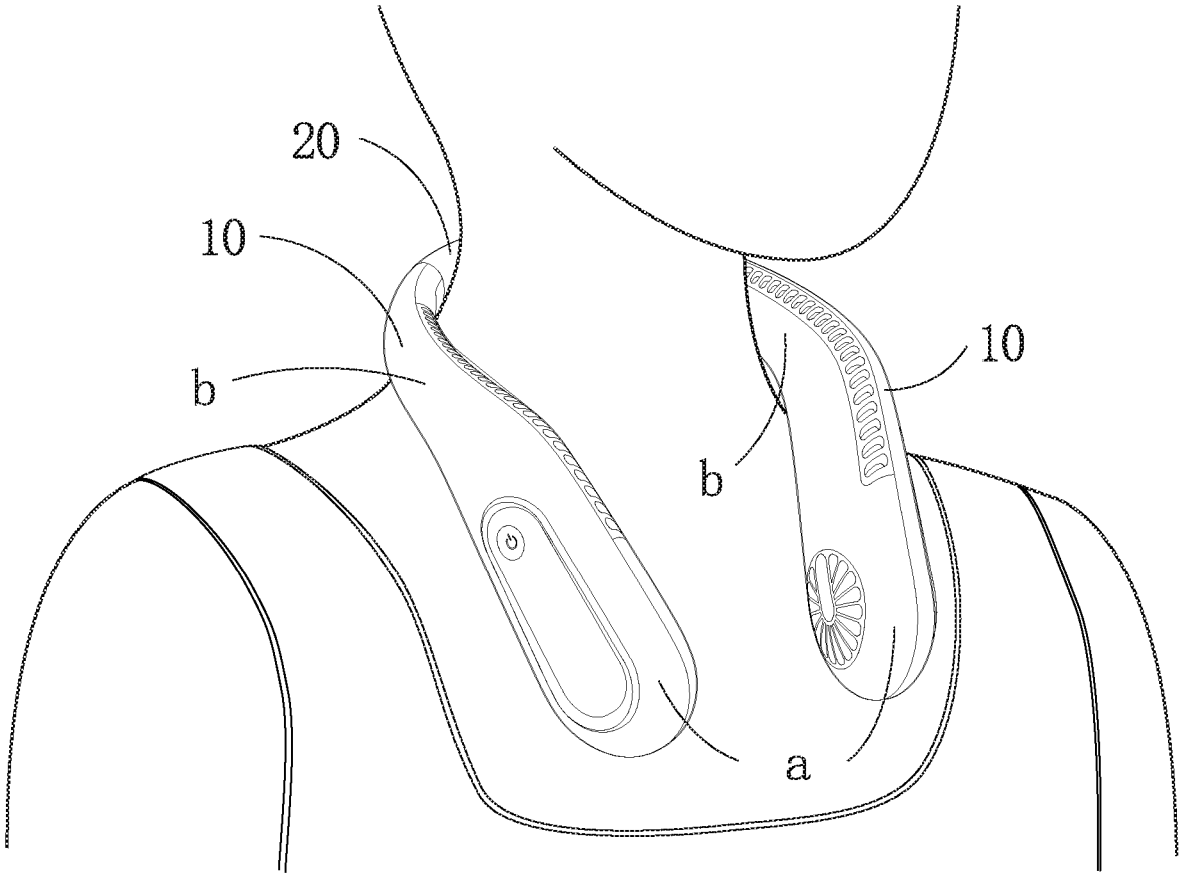
FIG. 1 is a schematic diagram showing the wearing state of the neck fan according to an embodiment of the invention.
Figure 2:
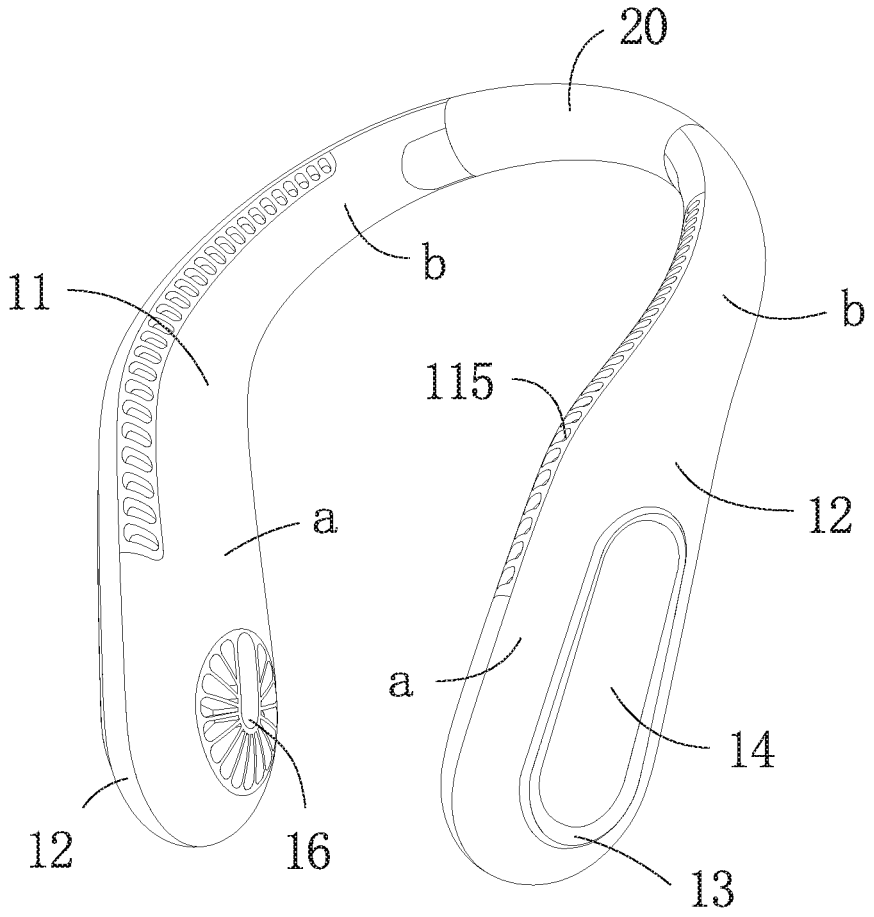
FIG. 2 is a schematic diagram showing of the structure of the neck fan provided by the invention.
Figure 3:
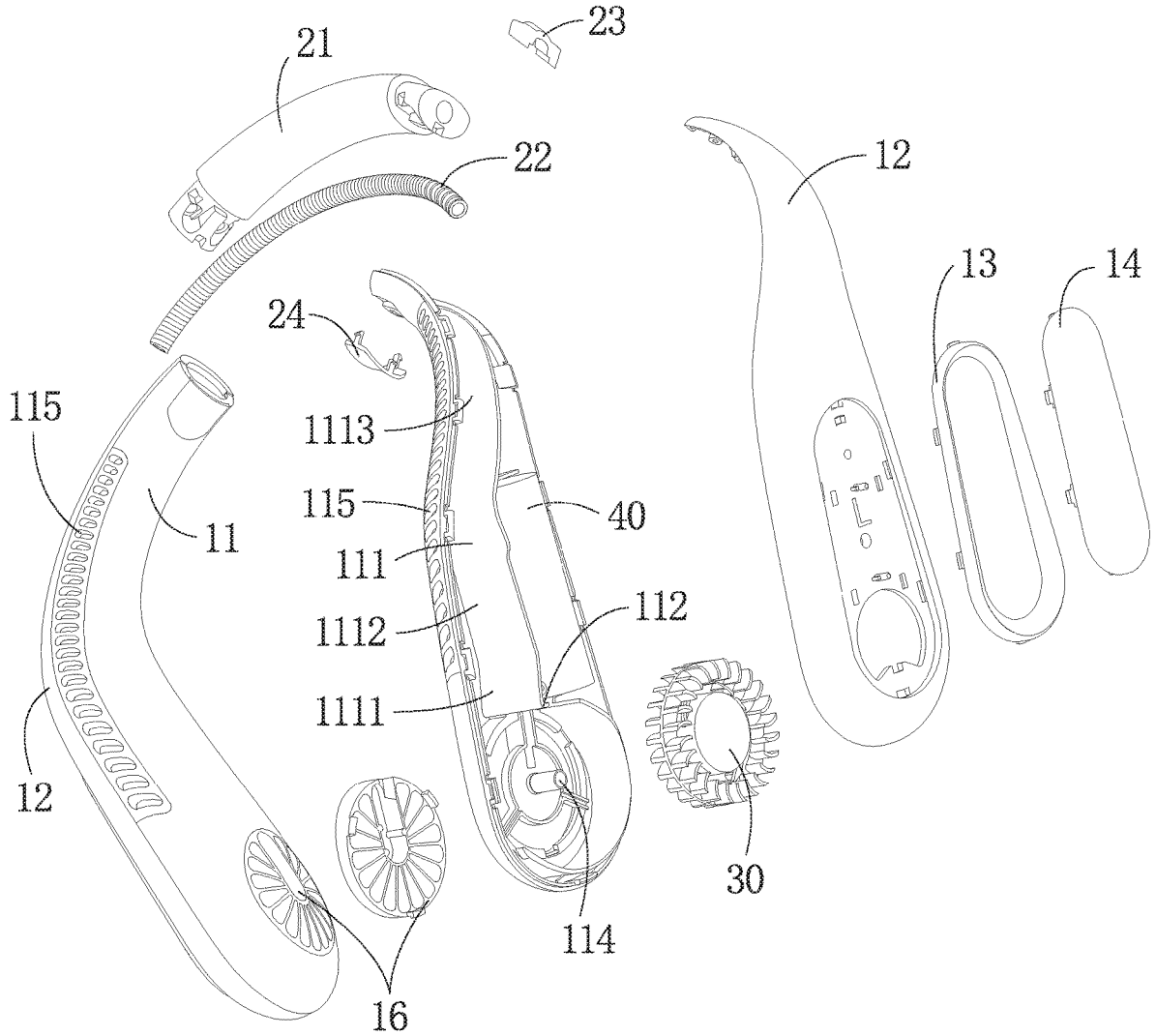
FIG. 3 is a schematic diagram showing an exploded view of the neck fan shown in FIG. 2 of the invention from one perspective.
Figure 4:
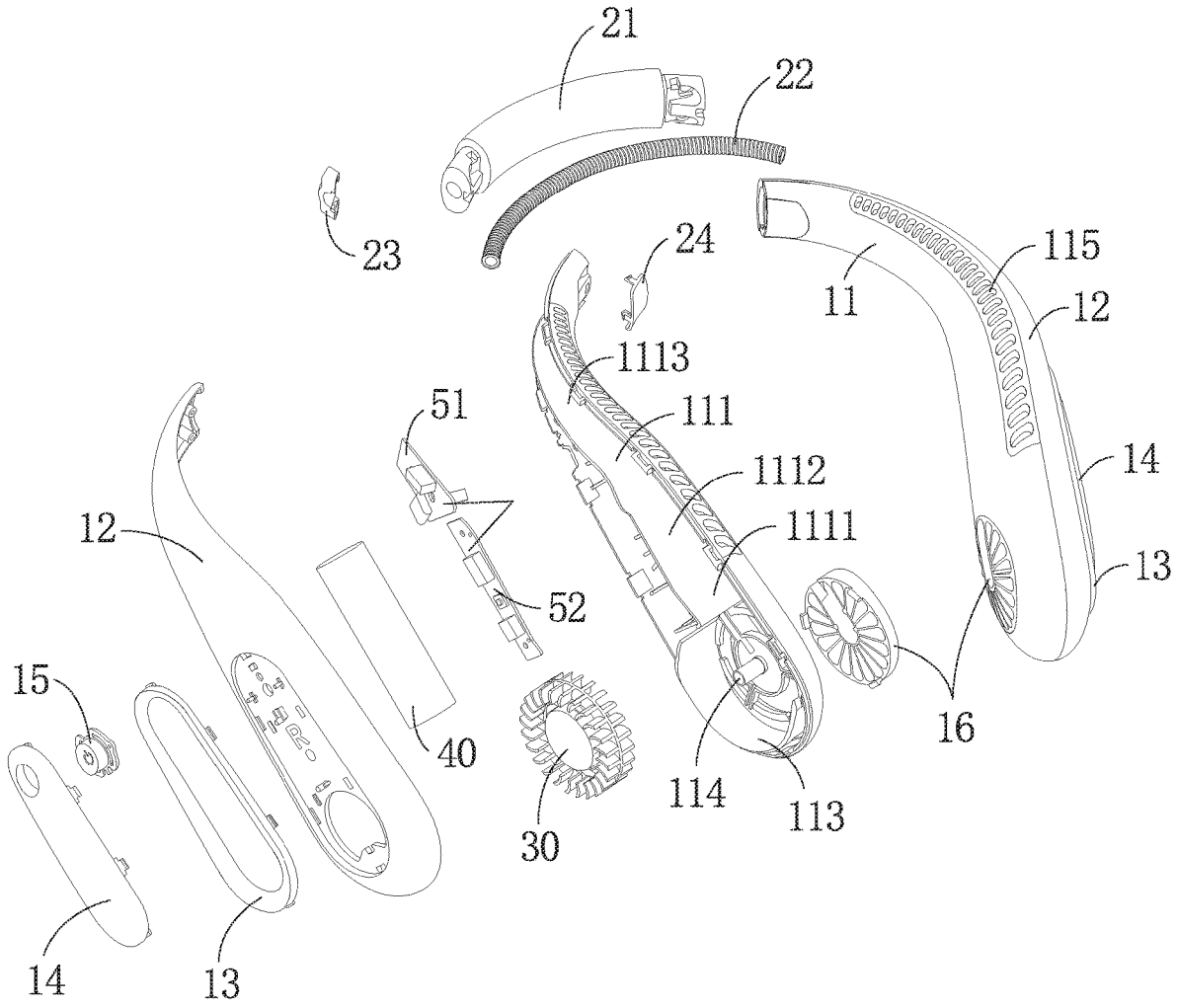
FIG. 4 is a schematic diagram showing an exploded view of the neck fan shown in FIG. 2 of the invention from another perspective.

In the figures: 10. fan shell; 11. shell body; 111. air guide component; 1111. front segment; 1112. middle segment; 1113. rear segment; 112. windward angle; 113. cavity wall; 114. positioning pin; 115. air outlet hole; 116. air outlet assembly; 1161. fan cavity; 1162. air duct; 117. storage cavity; 12. shell rear cover; 13. decorative ring; 14. decorative cover plate; 15. control button; 16. air window; 20. silicone assembly; 21. silicone sleeve; 22. metal spring hose; 23. fixing component; 30. fan; 40. energy storage battery; 50. control unit; 51. control mainboard; 52. switch function board.

5. SPECIFIC EMBODIMENT OF THE INVENTION

Referring to FIG. 1-6, the invention provides a technical solution of an ergonomic neck fan, comprising two fan shells 10 provided in mirror image for wearing around the neck of the user, and a silicone assembly 20 provided between the two fan shells 10 for connecting the two fan shells 10 together. The interior of each fan shell 10 is provided with a fan 30 and a cavity wall 113. The inner side of the a-segment end of each fan shell 10 is provided with an air window 16 opposite to the fan 30. Each fan shell 10 comprises a hollow shell body 11 and a shell rear cover 12 for clamping with the shell body 11. The outer side wall of the shell rear cover 12 is provided with a decorative ring 13, a decorative cover plate 14 and control buttons 15. To facilitate easy operation of the neck fan, the control buttons 15 are provided on the shell rear cover 12. The invention provides the decorative ring 13 and decorative cover plate 14, so that after the control buttons 15 are assembled with the decorative ring 13 and decorative cover plate 14, the neck fan can have an atmospheric appearance, comfortable hand-gripping, and flexible button-pressing.

The interior of each fan shell 10 is provides with an air guide component 111, so that the air guide component 111 is installed inside the shell body 11. The air guide component 111 cooperates with the cavity wall 113 to partition the interior space of the shell body 11 into an air outlet assembly 116 and a storage cavity 117. The outer wall of the shell body 11 is provided with air outlet holes 115. The aforementioned silicone assembly 20 is provided in an arc-shaped structure, and b-segment of each fan shell 10 together with the silicone assembly 20 surrounds the rear portion of a human neck. The aforementioned silicone assembly 20 is fixed to the fan shell 10 through a fixing component 23, and the silicone assembly 20 is composed of a silicone sleeve 21 and a metal spring hose 22. The metal spring hose 22 penetrates through the silicone sleeve 21 which has a hollow structure. The metal spring hose 22 can be arbitrarily bent and plastically deformed, and the silicone assembly 20 can be flexibly adjusted according to the neck thickness of different people for comfortable wearing without choking the neck. The fixing component 23 employs but is not limited to snaps or screws, so that the silicone assembly 20 can connect the two fan shells 10 together.

It should be noted that, according to the cylindrical characteristics of the human neck, the fan shell 10 and silicone assembly 20 are designed in the arc shape to surround the rear and sides of the human neck. According to the wider and uneven convex upper characteristics of the human shoulder, the fan shell 10 starts with a downward hanging design at the human clavicle and appropriately converges inward towards the center of the human chest. The storage cavity 117 inside the downward hanging a-segment of the fan shell 10 holds the control unit 50 and energy storage battery 40 of the fan, with the entire gravity of the fan pointing downwards to the lowest end of fan 30, providing the most stable wearing experience for the human body. The fan shell 10 starts to hang down at the human clavicle and slightly converges towards the midpoint of the human chest. The angle formed between the arc-shaped plane of the shell body 11 around the neck and the downward hanging a-segment plane of the fan shell 10 is 140 degrees, fitting the structure of the human shoulder. The air outlet holes 115 at the downward hanging a-segment of the fan shell 10 blow towards the human face, and the air outlet holes 115 at the arc-shaped b-segment of the fan shell 10 blows towards the human neck.

Figure 5:
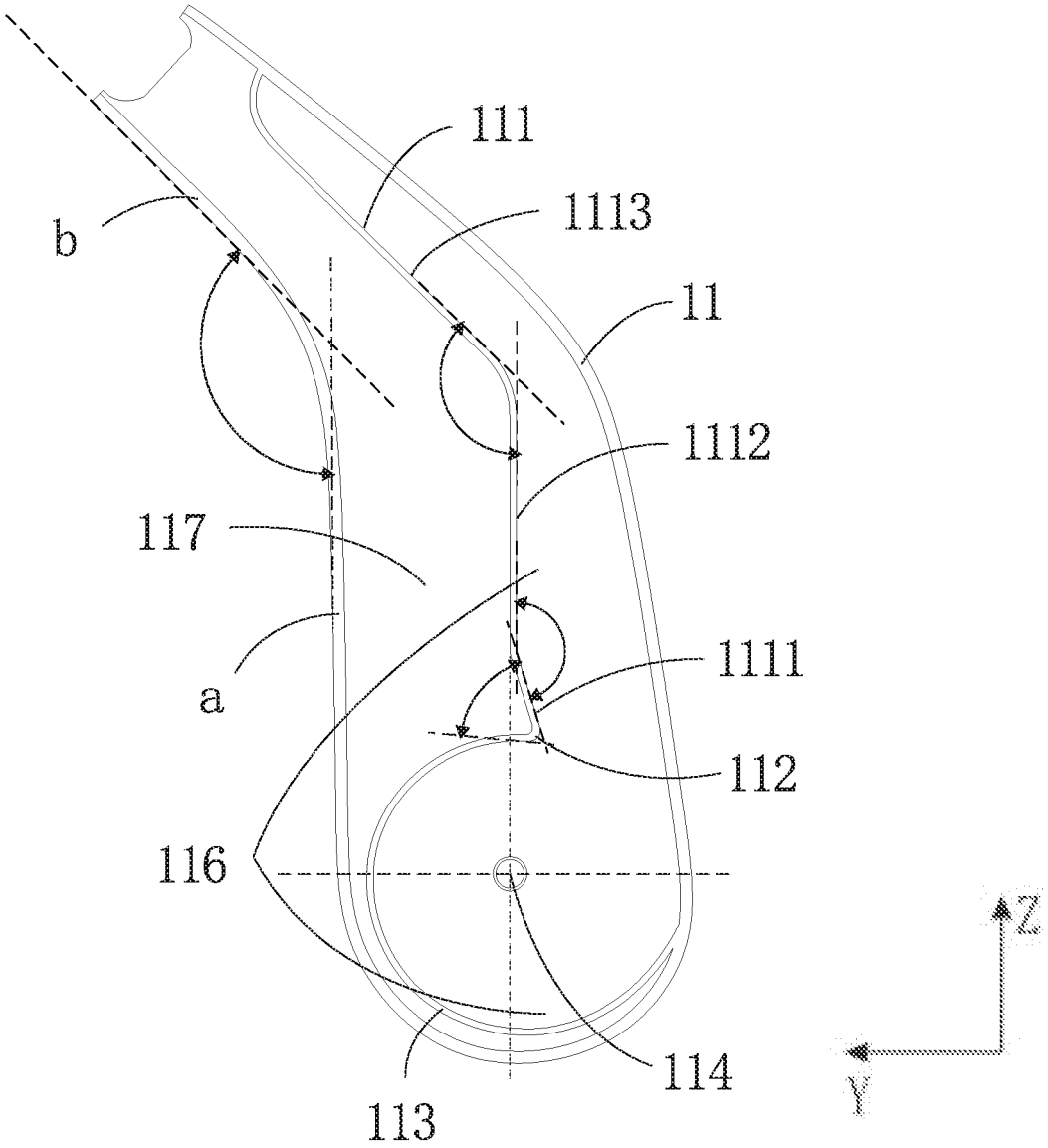
FIG. 5 is a schematic diagram showing a Y-Z plane projection view of the neck fan shell body shown in FIG. 2 of the invention.
Figure 6:
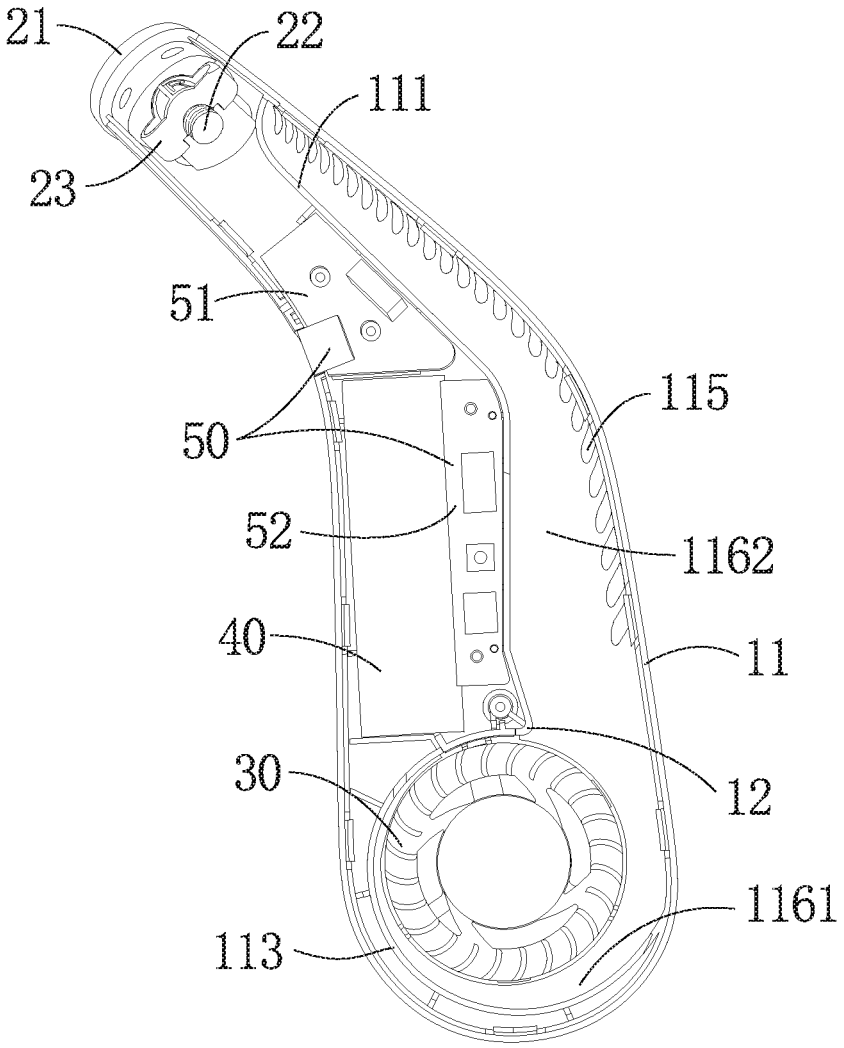
FIG. 6 is a schematic diagram showing the installation view of the neck fan shell body shown in FIG. 2 of the invention.

In this embodiment, in conjunction with FIG. 5 and FIG. 6, the air outlet assembly 116 comprises a fan cavity 1161 for accommodating fan 30, and a horn-shaped air duct 1162. The fan cavity 1161 is connected to the air duct 1162. The air duct 1162 communicates with the air outlet hole 115. The air duct 1162 is formed by the air guide component 111 cooperating with the shell body 11. The air guide component 111 consists of a front segment 1111, a middle segment 1112, and a rear segment 1113, and is provided in an irregular Z-shaped three-segment structure. The front segment 1111 of the air guide component 111 intersects with the cavity wall 113, and the intersection forms a windward angle 112 of 50 to 80 degrees. The front segment 1111 of the air guide component 111 is perpendicular to the air duct 1162 to form the second section of the air duct 1162. The front segment 1111 of the air guide component 111 is connected to the cavity wall 113. The middle segment 1112 of the air guide component 111 forms a cross-sectional area of the air duct 1162 formed by the fan shell 10 that gradually decreases. The rear segment 1113 of the air guide component 111 forms an angle of 100 to 150 degrees with the middle segment 1112 of the air guide component 111. The angle between the rear segment 1113 and the middle segment 1112 of the air guide component 111 is 125 to 140 degrees. The air outlet holes 115 start to be continuously provided along the top surface of the second section of the air duct 1162 towards the tail of the air duct 1162. The air outlet hole 115 has a rounded rectangular structure with the outline dividing lines between the air outlet hole 115 and the fan shell 10 forming equally spaced angles of 65 to 85 degrees on the top surface of the air duct 1162 and the side surface of the shell body 11.

Preferably, in this embodiment, the angle between the rear segment 1113 and the middle segment 1112 of the air guide component 111 is 130 degrees, and the vertex of the angle has a rounded-angle structure, that is, the angle is treated with a large fillet of radius 15 mm, so that the accelerated airflow generated by the compressed air in the second section of the air duct 1162 can smoothly enter the third section of the air duct 1162 and reach the end of the air duct 1162 through the aforementioned large fillet treated angle, providing stronger airflow for the air outlet holes 115 surrounding the neck.

It should be noted that, a positioning pin 114 is provided on the downward extended line of the middle segment 1112 of the air guide component 111. The positioning pin 114 is provided on the storage cavity 117, and the fan 30 is provided on the downward extended line of the middle segment 1112 and proximate to the side of the windward angle 112. Wherein, the fan 30 adopts but is not limited to a centrifugal fan, the air window 16 is an air window with a segmented pie profile, and the air window 16 is provided on the lower circular hole of the fan shell 10 using a snap-fit structure. The diameter of the air window 16 is equal to the blade size of the fan 30 to ensure maximum air intake while preventing foreign objects from being sucked into the fan 30 and affecting normal operation and use of the neck fan. The rear segment 1113 of the air guide component 111 is smoothly connected to the middle segment 1112, and gradually converges to the tail of the fan shell 10. The air is compressed and accelerated in the second section of the air duct 1162, and can continuously flow to the end of the air duct 1162, achieving relatively strong airflow discharged from the air outlet holes 115 along the way and blowing to both sides of the human neck. Wherein, the middle segment 1112 of the air guide component 111 is lifted upward to form an angle of about 160 degrees with the front segment 1111 of the air guide component 111, and the cross-section of the air duct 1162 formed by the fan shell 10 gradually contracts and decreases. The second section of the air duct 1162 guides the airflow to transmit upwards, so that part of the air is discharged from the top surface air outlet holes 115 of the second section of the air duct 1162 and blows to the human face, while the airflow speed of the compressed air increases and accelerates into the third section of the air duct 1162, ensuring that there is still sufficient strong airflow discharged from the tail of the air duct 1162 to blow to the human neck.

Wherein, in this embodiment, the windward angle 112 is provided for reducing the noise generated by high-speed airflow in the air duct 1162. The included angle of the windward angle 112 is 60 to 70 degrees, and the vertex of the windward angle 112 has an inverted rounded-angle structure, that is, the front segment 1111 of the air guide component 111 intersects with the cavity wall 113 of the fan 30, and forms a windward angle 112 of 65 degrees with the tangent of the intersection, in order to reduce the noise formed by the impact of high-speed airflow on the windward angle 112, the vertex of the windward angle 112 is treated with an inverted fillet of 0.5 mm. Wherein, the flared air duct 1162 is formed by the front segment 1111 of the air guide component 111 and the air duct 1162 of the fan shell 10, which appears flared from bottom to top, thereby slowing down the impact of high-speed airflow entering the air duct 1162 on the air guide component 111 and reducing noise. Wherein, the middle segment 1112 of the air guide component 111 is lifted upwards to change the airflow direction, allowing part of the airflow to be discharged from the air outlet holes 115 in this part and blow to the human face. The cross-section of the air duct 1162 formed by the middle segment 1112 of the air guide component 111 and the fan shell 10 gradually decreases. According to aerodynamics, that is, the Bernoulli's principle, the airflow velocity entering the second section of the air duct 1162 will increase due to channel narrowing and air compression.

In this embodiment, the ergonomic neck fan further comprises an energy storage battery 40 and a control unit 50 provided inside the fan shell 10. The a-segment of the fan shell 10 starts from the human clavicle and hangs down along the shoulder. The two a-segments of the fan shells 10 converge towards the center of the human chest, and the cavity of a-segment gradually enlarges to accommodate the fan 30, the energy storage battery 40 and the control unit 50. Both the energy storage battery 40 and the control unit 50 are provided in the storage cavity 117. The control unit 50 consists of a control mainboard 51 and a switch function board 52. The switch function board 52 is connected to the control buttons 15. The control mainboard 51 is provided on the positioning pin 114 in the storage cavity 117, and adopts Type-C charging to complete the state indication and battery control of the neck fan. The control wires of the energy storage battery 40 and the fan 30 pass through the metal spring hose 22 to achieve synchronous control of the fan 30 in the neck fan. Wherein, the energy storage battery 40 adopts but is not limited to a cylindrical battery or a block polymer battery. When installing the energy storage battery 40, sufficient space needs to be reserved in the internal storage cavity 117 of the shell body 11. Wherein, the wires of the fan 30 and energy storage battery 40 can be hidden and pass through the hollow metal spring hose 22 to enable the control unit 50 to control the left and right fans of the neck fan.

The air outlet holes 115 of the ergonomic neck fan are provided to blow the airflow generated by the fan 30 towards the human face and neck. The air outlet holes 115 are designed to comply with the airflow direction and can also guide the discharge direction of the airflow. Air outlet holes 115 are continuously provided along the top surface of the second section of the air duct 1162 towards the tail of the air duct 1162. In this embodiment, twenty-seven air outlet holes 115 can be provided from large to small. The air outlet holes 115 have a rounded rectangular structure with the outline dividing lines between the air outlet holes 115 and the fan shell 10 forming equally spaced angles of 65-85 degrees on the top surface of the air duct 1162 and the side surface of the shell body 11. Wherein, the shell body 11 is made of 2.0 mm plastic material, with the 2.0 mm thickness of the plastic shell body 11, the hole walls of the air outlet holes 115 form air passageways. The airflow passageways of the second section of the air duct 1162 are perpendicular to the front segment 1111 of the air guide component 111 to ensure that the airflow in the second section of the air duct 1162 can be partially discharged upwards to blow to the human face.

It should be noted that, in this novel ergonomic neck fan, the front segment 1111 of the air guide component 111 is about 1.5 cm long and is connected to the cavity wall 113 of the fan 30, forming an angle of about 135 degrees with the middle segment 1112 of the air guide component 111 at the connection. The front segment 1111 of the air guide component 111 forms the first section of the air duct 1162 with the fan shell 10. The first section of the air duct 1162 is connected to the fan cavity 1161, following the direction of the high-speed airflow transferred from the fan cavity 1161. Wherein, the positioning pin 114 of the fan 30 is located on the downward extended line of the middle segment 1112 of the air guide component 111. The fan 30 is provided on this extended line close to the side of the windward angle 112, with the minimum distance of 1 mm from the cavity wall 113 of the fan 30, and the maximum distance of 6.5 to 7.0 mm from the cavity wall 113 of the fan 30. After installation of the fan 30, the entire fan cavity 1161 forms a spiral cavity. The fan 30 drives the air entering the fan cavity 1161 through the air window 16 to be accelerated and injected into the air duct 1162. The minimum gap at the windward angle 112 ensures that the minimum amount of air enters the secondary cycle. The fan 30 rotates in the fan cavity 1161 to form high-speed airflow and inject it into the air duct 1162. The air duct 1162 meets the aerodynamic requirements to keep the high-speed transmission of airflow in the air duct 1162, and blow out from the air outlet holes 115 towards the face and both sides of the neck of the human body at a relatively high wind speed. Wherein, the fan 30 is fixed on the positioning pin 114 to form a spiral cavity.

What is claimed is:

1. An ergonomic neck fan, comprising two fan shells provided in mirror image for wearing around the neck of the user, and a silicone assembly provided between the two fan shells for connecting the two fan shells, wherein the interior of each fan shell is provided with a fan and a cavity wall; wherein an air window is provided inside each fan shell, and each fan shell comprises a hollow shell body and a shell rear cover clamped to the shell body; the interior of each fan shell is provided with an air guide component, to cooperate with the cavity wall to divide an interior space of the shell body into an air outlet assembly and a storage cavity, and an outer wall of the shell body is formed with air outlet holes thereon;

the air outlet assembly comprises a fan cavity for accommodating the fan and a horn-shaped air duct connected to the fan cavity; the air duct communicates with hole passages of the air outlet holes and is formed by the air guide component cooperating with the shell body; the air guide component is provided in a "Z" shaped three-segment structure consisting of a first segment connecting the "Z" shaped three-segment structure to the cavity wall with a windward angle of 50 to 80 degrees, a second segment connected to the first segment, and a third segment connected to the second segment.

2. An ergonomic neck fan as claimed in claim 1, wherein the first segment of the "Z" shaped three-segment structure of the air guide component is provided perpendicular to the air duct, the third segment of the "Z" shaped three-segment structure forms a 100 to 150 degrees angle with the second segment; each air outlet hole is provided in a rounded rectangular structure.

3. An ergonomic neck fan as claimed in claim 2, wherein the angle between the third segment and the second segment of the "Z" shaped three-segment structure of the air guide component is 125 to 140 degrees, and the angle vertex is provided with a rounded-angle structure.

4. An ergonomic neck fan as claimed in claim 1, wherein a positioning pin is provided on the storage cavity; and the fan is fixed to the positioning pin to form a spiral cavity.

5. An ergonomic neck fan as claimed in claim 1, wherein the windward angle is provided for reducing noise generated by the high-speed airflow in the air duct; an included angle of the windward angle is 60 to 70 degrees, and a vertex of the windward angle is provided in an inverted rounded-angle structure.

6. An ergonomic neck fan as claimed in claim 1, wherein the fan adopts a centrifugal fan.

* * * * *